US009534418B2

(12) United States Patent
Wallulis

(10) Patent No.: US 9,534,418 B2
(45) Date of Patent: Jan. 3, 2017

(54) CONCRETE MOUNTING SYSTEMS, APPARATUSES, AND METHODS FOR FENCES AND OTHER CONCRETE MOUNTED STRUCTURES

(71) Applicant: Stanley George Wallulis, Wilsonville, OR (US)

(72) Inventor: Stanley George Wallulis, Wilsonville, OR (US)

( * ) Notice: Subject to any disclaimer, the term of this patent is extended or adjusted under 35 U.S.C. 154(b) by 0 days.

(21) Appl. No.: 14/945,218

(22) Filed: Nov. 18, 2015

(65) Prior Publication Data

US 2016/0138298 A1 May 19, 2016

Related U.S. Application Data

(60) Provisional application No. 62/081,169, filed on Nov. 18, 2014, provisional application No. 62/089,735, filed on Dec. 9, 2014, provisional application No. 62/256,481, filed on Nov. 17, 2015.

(51) Int. Cl.
*E04H 17/22* (2006.01)
*E02D 27/42* (2006.01)

(52) U.S. Cl.
CPC ..... *E04H 17/22* (2013.01); *E02D 27/42* (2013.01)

(58) Field of Classification Search
CPC ..... E04H 17/22; E04H 12/2269; E02D 27/02; E02D 27/42
See application file for complete search history.

(56) References Cited

U.S. PATENT DOCUMENTS

| | | | | |
|---|---|---|---|---|
| 3,920,221 | A | 11/1975 | Berry et al. | |
| 4,286,772 | A | 9/1981 | Parisien | |
| 4,508,320 | A | 4/1985 | Hegarty | |
| 5,015,117 | A | 5/1991 | Pawlicki | |
| 5,456,441 | A | 10/1995 | Callies | |
| 5,632,464 | A | 5/1997 | Aberle | |
| 5,666,774 | A | 9/1997 | Commins | |
| 6,015,138 | A | 1/2000 | Kohlberger et al. | |
| 6,098,353 | A | 8/2000 | Stanfield | |
| 6,173,945 | B1 | 1/2001 | Lindsey et al. | |
| 6,176,471 | B1 | 1/2001 | Naegele et al. | |
| 6,519,906 | B2 * | 2/2003 | Yost | E04B 2/8635 249/18 |
| 6,745,529 | B2 | 6/2004 | Beltran | |
| 7,325,790 | B2 | 2/2008 | Lee | |

(Continued)

*Primary Examiner* — Victor MacArthur
(74) *Attorney, Agent, or Firm* — Kolisch Hartwell, P.C.

(57) ABSTRACT

Concrete mounting apparatuses, concrete connector installation assemblies, and methods of installing a concrete mounting apparatus are disclosed. In some embodiments, the concrete mounting apparatus may include a mounting base that is planar and is configured to be supported on concrete. The mounting base may include a plurality of apertures sized to receive one or more fasteners. The apparatus may additionally include an attachment member attached to, or formed with, the mounting base. The apparatus may further include a support member configured to be supported on the mounting base. The support member may include a hole configured to receive at least a portion of the attachment member, a plurality of holes that is adjacent to the attachment member when the attachment member is received in the hole, and one or more spaced fins configured to receive one or more rails of the fence.

7 Claims, 16 Drawing Sheets

(56) References Cited

U.S. PATENT DOCUMENTS

| | | | | |
|---|---|---|---|---|
| 7,866,636 | B1 | 1/2011 | Hansen | |
| 7,896,309 | B1 * | 3/2011 | DiGiammo | B28B 23/0056 24/303 |
| 2003/0209701 | A1 | 11/2003 | Goddard | |
| 2011/0186796 | A1 * | 8/2011 | Platt | B23P 17/04 256/65.14 |
| 2013/0175422 | A1 * | 7/2013 | Clarke | E04H 12/2261 248/523 |
| 2013/0212966 | A1 | 8/2013 | Knudsen | |
| 2013/0256619 | A1 | 10/2013 | Bailey et al. | |

* cited by examiner

CONCRETE MOUNTING SYSTEMS, APPARATUSES, AND METHODS FOR FENCES AND OTHER CONCRETE MOUNTED STRUCTURES

CROSS-REFERENCE TO RELATED APPLICATIONS

This application claims the benefit of the following applications: (1) U.S. Provisional Patent Application Ser. No. 62/081,169, which was filed on Nov. 18, 2014 and entitled "Fence Systems;" (2) U.S. Provisional Patent Application Ser. No. 62/089,735, which was filed on Dec. 9, 2014 and entitled "Fence Systems;" and (3) U.S. Provisional Patent Application Ser. No. 62/256,481, which was filed on Nov. 17, 2015 and entitled "Fence Systems." The complete disclosure of the above applications are hereby incorporated by reference for all purposes.

BACKGROUND OF THE DISCLOSURE

Fences are freestanding structures that are designed to restrict or prevent movement across a boundary. Fences can be made of any suitable materials, such as wood, metal, concrete, and/or other materials. Some fences include vertically oriented posts that are inserted into a hole in the ground and the hole is then filled with dirt and/or cement.

Examples of fences are disclosed in U.S. Pat. Nos. 3,920,221; 4,286,772; 4,508,320; 5,015,117; 5,456,441; 5,632,464; 5,666,774; 6,015,138; 6,098,353; 6,173,945; 6,176,471; 6,745,529; 7,325,790; and 7,866,636; and U.S. Patent Application Publication Nos. 2003/0209701, 2013/0212966, and 2013/0256619. The complete disclosures of the above patents and patent applications and all other publications referenced in the present disclosure are hereby incorporated by reference for all purposes.

SUMMARY OF THE DISCLOSURE

Some embodiments may provide a concrete mounting apparatus for a fence. The concrete mounting apparatus may include a mounting base that is planar and is configured to be supported on concrete. The mounting base may include a plurality of apertures sized to receive one or more fasteners. The concrete mounting apparatus may additionally include an attachment member attached to, or formed with, the mounting base. The concrete mounting apparatus may further include a support member configured to be supported on the mounting base. The support member may include a hole configured to receive at least a portion of the attachment member when the support member is supported on the mounting base. The support member may additionally include a plurality of holes that is adjacent to the attachment member when the attachment member is received in the hole. The plurality of holes may be sized to receive one or more couplers to secure the support member to the attachment member. The support member may further include one or more spaced fins configured to receive one or more rails of the fence.

Some embodiments may provide a concrete connector installation assembly. The concrete connector installation assembly may include an installation base that is planar and is configured to be supported on concrete in a concrete form. The installation base may include a plurality of apertures sized to receive one or more fasteners. The concrete connector installation assembly may additionally include a stabilizer base that is planar and is configured to be attached to a top portion of the installation base. The stabilizer base may include a plurality of openings sized to receive one or more stabilizer elements. The stabilizer base may extend outside the concrete form when the stabilizer base is attached to the top portion and the installation base is supported on the concrete. The plurality of openings may be positioned such that a stabilizer element inserted in one or more of the plurality of openings contacts at least one outside wall of the concrete form when the stabilizer base is attached to the top portion and the installation base is supported on the concrete.

Some embodiments may provide a method of installing a concrete mounting apparatus for a fence. The method may include positioning a plurality of connectors at a predetermined distance below a top surface of concrete in a concrete form during curing of the concrete. The method may additionally include forming one or more channels from the top surface to the plurality of connectors during curing of the concrete. The method may further include attaching a concrete mounting apparatus to one or more of the plurality of connectors through the one or more formed channels of the cured concrete. The concrete mounting apparatus may be configured to support one or more rails of the fence.

Some embodiments may provide a concrete mounting system for a fence. The concrete mounting system may include a concrete connector installation assembly. The concrete connector installation assembly may include an installation base that is planar and is configured to be supported on concrete in a concrete form. The installation base may have a plurality of apertures sized to receive one or more fasteners. The concrete connector installation assembly may additionally include a stabilizer base that is planar and is configured to be attached to a top portion of the installation base. The stabilizer base may include a plurality of openings sized to receive one or more stabilizer elements. The stabilizer base may extend outside the concrete form when the stabilizer base is attached to the top portion and the installation base is supported on the concrete. The plurality of openings may be positioned such that a stabilizer element inserted in one or more of the plurality of openings contacts at least one outside wall of the concrete form when the stabilizer base is attached to the top portion and the installation base is supported on the concrete.

The concrete mounting system may additionally include a concrete mounting apparatus. The concrete mounting apparatus may include a mounting base that is planar and is configured to be supported on concrete. The mounting base may include a plurality of apertures sized to receive one or more fasteners. The concrete mounting apparatus may additionally include an attachment member attached to, or formed with, the mounting base. The concrete mounting apparatus may further include a support member configured to be supported on the mounting base. The support member may include a hole configured to receive at least a portion of the attachment member when the support member is supported on the mounting base. The support member may additionally include a plurality of holes that is adjacent to the attachment member when the attachment member is received in the hole. The plurality of holes may be sized to receive one or more couplers to secure the support member to the attachment member. The support member may further include one or more spaced fins configured to receive one or more rails of the fence.

DETAILED DESCRIPTION OF THE DISCLOSURE

Figure 1:
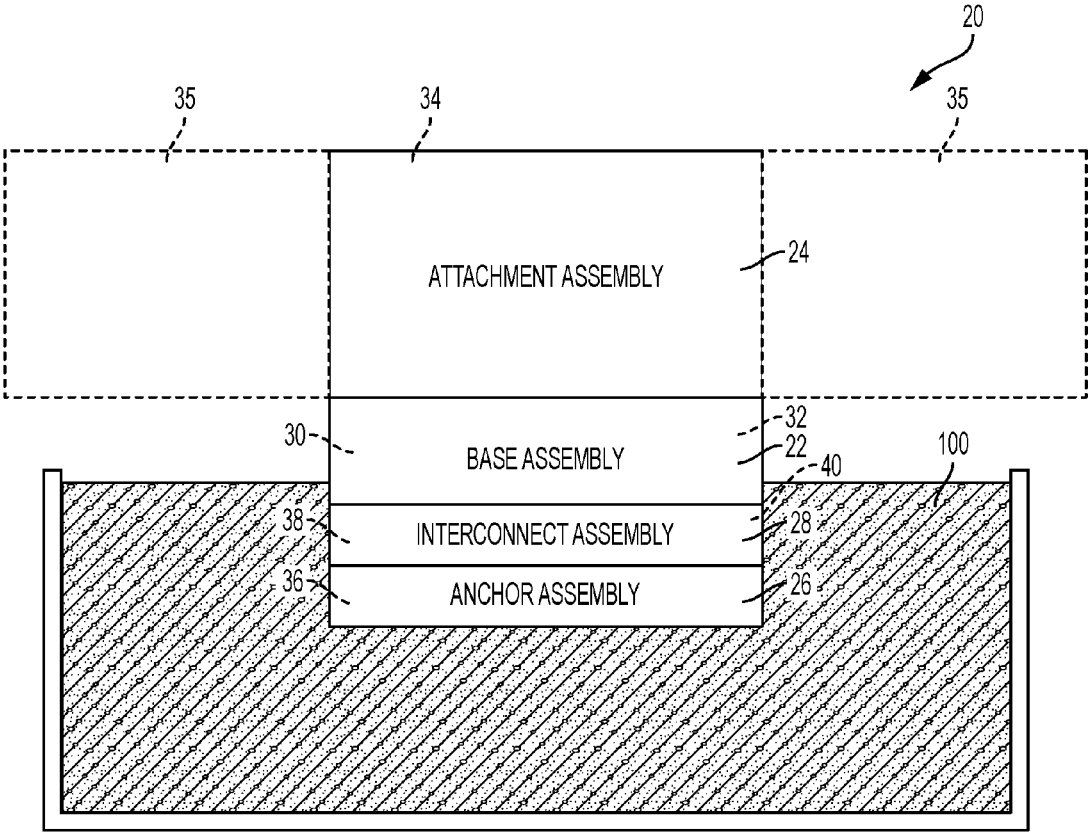
FIG. 1 is a block diagram of an example of a concrete mounting apparatus for a fence.

FIG. 1 shows an example of a concrete mounting apparatus 20, which may include a base assembly 22 and an attachment assembly 24. Base assembly 22 may include any suitable structure configured to be attached to an anchor assembly 26 via an interconnect assembly 28 and/or to receive attachment assembly 24. For example, base assembly 22 may include a main base or mounting base 30 and an attachment member 32.

Main base 30 may have a plurality of apertures and/or holes sized to receive one or more fasteners. The main base may be any suitable shape(s) and/or size(s). For example, the main base may be planar. In some examples, the main base may include one or more magnets and/or other suitable connector configured to receive a level (such as a spirit level) to allow a user to determine, for example, whether the main base is horizontal. In some examples, the base assembly may include one or more adjustment members (such as shims or washers) that may be placed and/or positioned below the main base to adjust the orientation of the main base, such as to make the main base horizontal.

Attachment member 32 may be attached to and/or formed with main base 30 and may include any suitable structure configured to receive and/or support attachment assembly 24. Additionally, the attachment member may be any suitable size(s) and/or shape(s). For example, attachment member 32 may be a cube, cuboid, cylinder, prism, tube, and/or other suitable shape. The attachment member may be solid and/or hollow. In some examples, the base assembly may include a pad, such as a rubber or plastic pad. The pad may be attached to the main base and/or may be configured to protect the main base from abrasion and/or corrosion. In some examples, the base assembly may include one or more structural bands configured to support the main base and/or the main post and to prevent those components from buckling.

Attachment assembly 24 may include any suitable structure configured to be attached to base assembly 22 and/or to support one or more structural members, such as one or more rails of a fence. For example, attachment assembly 24 may include a support member 34. The support member may be the same shape(s) as attachment member 32 but may be larger such that an opening in the support member can receive the attachment member and/or be supported on the main base. The support member may be slightly taller, taller, or substantially taller than the main post. Support member 34 may include one or more apertures or holes configured to receive one or more couplers (such as bolts) to secure the support member to the attachment member. Plastic covers and/or other barriers may be added to the end of the couplers to prevent abrasion and/or stress points, such as to prevent corrosion. In some examples, the support member may include one or more vents, which may be in different locations of the support post.

Additionally, support member 34 may include one or more attachment elements, such as fins and/or other outwardly extending structures configured to receive one or more structural members 35, such as rail(s) of a fence. In some examples, the fins may include one or more apertures or holes configured to receive one or more couplers. The attachment elements may be spaced and/or located in various locations such that the support member may be used, for example, as an end support post, a corner or main support post, a line support post, etc. for a fence. When support member 34 is an end support post or main support post, one or more attachment elements may be configured to receive and/or support a brace post and/or other structure configured to provide additional support. Attachment assembly 24 may, in some examples, include a cap to cover the support member (such as an end of the support member). In some examples, the cap may include spring clips to secure the cap to the support post.

Anchor assembly 26 may include any suitable structure that provides one or more buried connections in concrete 100 for the concrete mounting apparatus. For example, anchor assembly 26 may include one or more connectors 36, such as nuts (e.g., hex nuts), expansion sleeves, and/or other suitable structure configured to receive one or more components of interconnect assembly 28.

Interconnect assembly 28 may include any suitable structure configured to connect base assembly 22 to anchor assembly 26. For example, interconnect assembly 28 may include one or more fasteners 38, such as bolts, screws, and/or other suitable structure configured to be received in anchor assembly 26 and/or connectors 36. The interconnect assembly may also include one or more shields 40 configured to prevent fasteners 38 (such as at least an upper portion) from adhering to the concrete portions such that the fasteners can be removed after curing of the concrete. For example, shield(s) 40 may include one or more greases (e.g., such as axle grease and/or other heavy greases), which may be applied to the fasteners. Additionally, or alternatively, shield(s) 40 may include one or more wraps (such as medical gauze wraps), which may be wrapped around the fasteners via a tape or other strapping structure.

Figure 2:
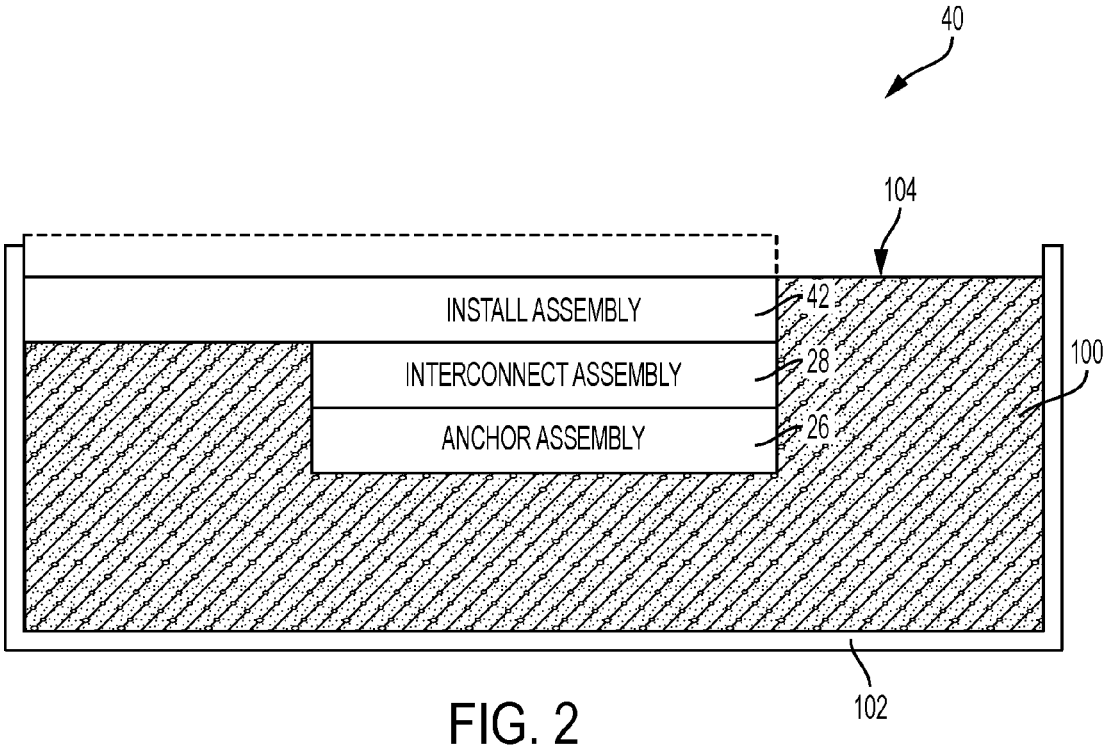
FIG. 2 is a block diagram of an example of a concrete connector installation assembly.

FIG. 2 shows an example of a concrete connector installation assembly 40, which may include any suitable structure configured to install anchor assembly 26 in concrete 100 in a concrete form 102. Concrete form 102 may be above and/or below ground. For example, concrete connector installation assembly 40 may include an install assembly 42 configured to install anchor assembly 26 via interconnect assembly 28. Install assembly 42 may include any suitable structure configured to position the anchor assembly in desired location(s) in concrete 100, such as when concrete 100 is in its intermediate "wet" stage and/or initial curing. The install assembly may be flush with a surface 104 of the concrete portions, or may be above that surface as shown in dashed lines in FIG. 2.

Figure 3:
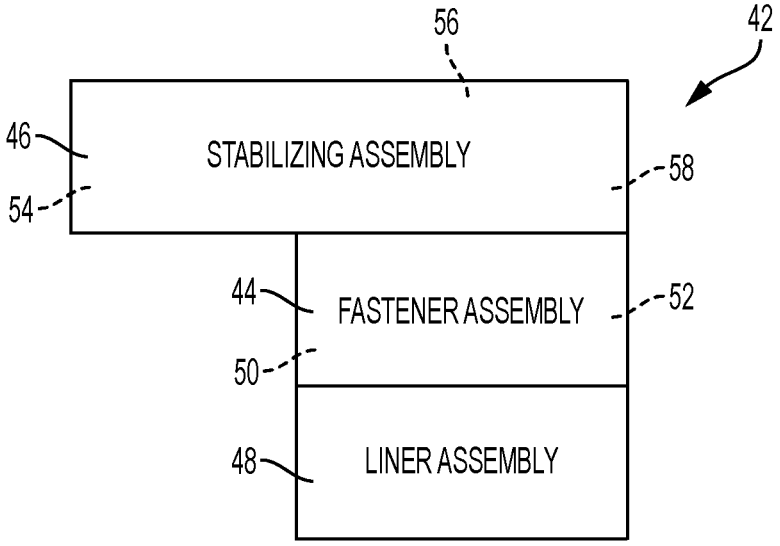
FIG. 3 is a block diagram of an example of an install assembly of the concrete connector installation assembly.

FIG. 3 shows an example of install assembly 42, which may include a fastener assembly 44, a stabilizing assembly 46, and a liner assembly 48. Fastener assembly 44 may include any suitable structure configured to receive and/or hold interconnect assembly 28. When interconnect assembly 28 includes fastener(s) 38, the fastener assembly may, for example, include an installation base or fastener base 50 having one or more fastener apertures or holes sized to receive the fastener(s). The fastener base may include any suitable number of fastener holes, such as one, two, three, four, five, six, or more holes. Additionally, the fastener base may be any suitable shape(s) and/or size(s). In some examples, the fastener assembly may include one or more magnets 52 and/or other suitable connector(s) attached to and/or received in (or on) the fastener base. The magnet (and/or other suitable connector(s)) may be configured to receive a level (such as a spirit level) to allow a user to determine, for example, whether the fastener base is horizontal.

Stabilizing assembly 46 may include any suitable structure configured to stabilize fastener assembly 44 in concrete 100, such as when concrete 100 is in its intermediate "wet" stage and/or initial curing. For example, stabilizing assembly 46 may include a stabilizer base or stabilizing base 54 having one or more stabilizing openings or slots 56 sized to receive one or more stabilizer elements 58, such as one or more wedges. Stabilizing base 54 and fastener base 50 may be a unitary formed piece or may be separate pieces fastened together via any suitable fastener(s). For example, the stabilizing base and the fastener base may include holes that correspond to each other when the stabilizing base is positioned on a top portion of the fastener base. The holes may receive coupler(s) and/or fastener(s) to attach the stabilizing base to the fastener base. When positioned on top of the fastener base, the stabilizing base may be larger or substantially larger than the fastener base to provide, for example, stability to the fastener base and/or to attach to at least a portion of the concrete form (such as one or more walls of the concrete form). At least a portion of the stabilizing base may have the same or substantially similar shape to the fastener base. In some examples, the stabilizing base and/or the fastener base may include additional apertures and/or holes sized to receive fasteners to secure and/or lock the base(s) to the concrete form.

Liner assembly 48 may include any suitable structure configured to prevent fastener assembly 44 and/or stabilizing assembly 46 from adhering to concrete 100. For example, liner assembly 48 may include plastic sheeting adhered via any suitable adhesive (such as mild adhesive) to the underside of the stabilizing base and/or fastener base. Alternatively, liner assembly 48 may include foil (such as aluminum foil) attached and/or adhered to the underside of the stabilizing base and/or fastener base.

Referring back to FIG. 1, base assembly 22 may occupy the same, more, or less area as install assembly 42 in concrete 100 in FIG. 2. In some examples, base assembly 22 may be attached to anchor assembly 26 via a different interconnect assembly than interconnect assembly 28. For example, base assembly 22 may be attached to one or more connectors 36 via one or more fasteners different from fasteners 38. The concrete mounting apparatus and the concrete connector installation assembly may collectively be referred to as a "concrete mounting system," such as a concrete mounting system for a fence.

In use, a user may position anchor assembly 26, interconnect assembly 28, and install assembly 42 in a desired position on the concrete during curing (or initial curing) of the concrete. A user may take one or more steps to prevent the interconnect assembly and the install assembly from adhering to the concrete as it cures, such as applying grease and/or wraps to the interconnect assembly, and applying a liner to the install assembly. A level may be attached to install assembly 42 to facilitate proper positioning. A user may repeat the process to install multiple anchor, interconnect, and install assemblies. When the concrete portion is cured, the install and interconnect assemblies may be removed leaving the anchor assembly in the cured concrete portion.

The user may then place the base assembly in the area previously occupied by the install assembly and connect the base assembly to the anchor assembly via an interconnect assembly, such as interconnect assembly 28. In some examples, a levelling rod (or level staff) may be used to ensure that the base assembly is vertical (or has a vertical orientation). The level staff may be attached to, for example, the main post, such as via one or more magnets. If necessary, one or more adjustment members may be used to ensure that the base assembly is vertical or about vertical. The attachment assembly may be attached to the base assembly, such as to the attachment member, via one or more couplers. One or more rails may be attached to adjustment members of the base assembly. The user may repeat the above process to install other base and attachment assemblies and to attach rails. When no longer in use, a user may detach the rails and detach the attachment assembly from the base assembly. Although particular steps are described for the example method above, other examples may add, omit, repeat, substitute, and/or modify the above steps.

Figure 4:
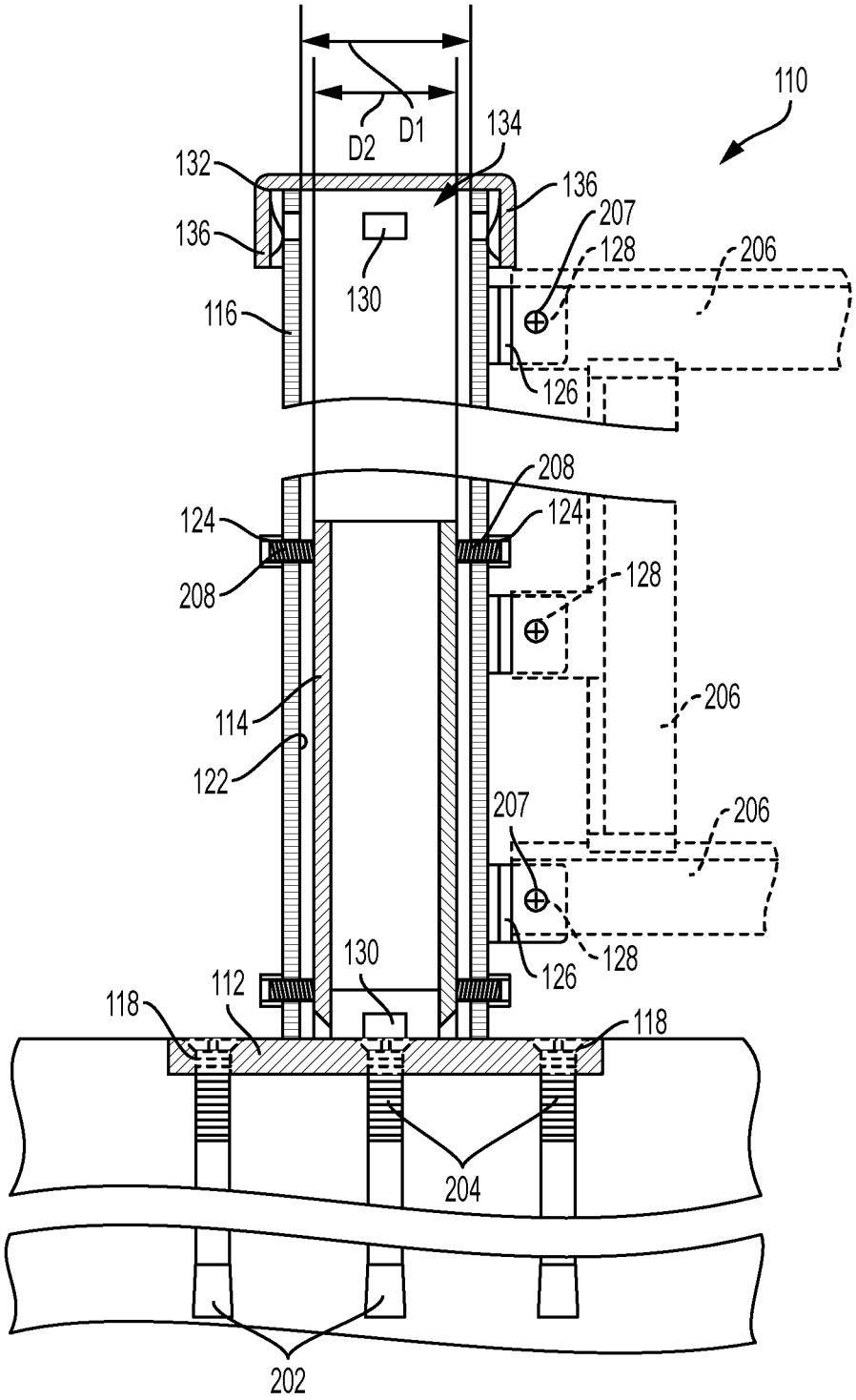
FIG. 4 is a sectional view of an example of a concrete mounting apparatus for a fence of FIG. 1 taken along lines 4-4 in FIG. 5, shown without the concrete to show fasteners and connectors.
Figure 5:
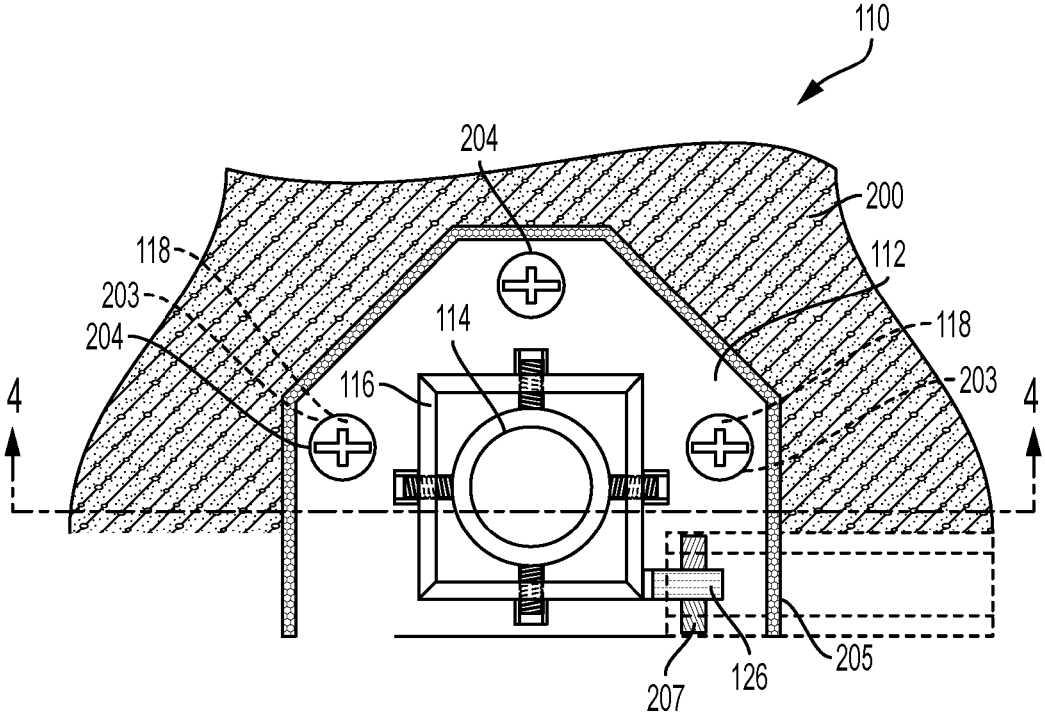
FIG. 5 is a top view of the concrete mounting apparatus of FIG. 4, shown without a cap.

FIGS. 4-5 show an example of a concrete mounting apparatus 20, which is generally indicated at 110. Unless specifically excluded, concrete mounting apparatus 110 may include one or more components and/or structures from other concrete mounting apparatuses described in the present disclosure. The concrete mounting apparatus may include any suitable structure configured to be mounted on concrete and/or to secure and/or support one or more rails of a fence. For example, concrete mounting apparatus 110 may include a mounting base 112, an attachment member 114, and a support member 116.

Mounting base 112 may include any suitable structure configured to be supported on cured concrete 200 and/or to connect to one or more concrete connectors 202 in the cured concrete. The concrete connector(s) may be accessible via one or more formed channels 203 in the cured concrete. Concrete fasteners 204 may attach to and/or detach from concrete connectors 202 via formed channel(s) 203.

Mounting base 112 may be planar and/or other suitable shape(s). For example, although mounting base 112 is shown to have a six-sided shape as shown in FIG. 5, the mounting base may be any suitable shape(s), such as one with a cross-sectional shape of a circle, triangle, square, rectangle, pentagon, hexagon, heptagon, octagon, etc., and may have any suitable number of sides, such as one, three, four, five, seven, eight, nine, ten, etc. Additionally, the mounting base may include a plurality of mounting apertures 118. The apertures may be sized to receive one or more concrete fasteners 204. The mounting base may include any suitable number of apertures, such as one, two, three, four, five, six, seven, eight, or more apertures. Additionally, apertures 118 may be positioned in any suitable portion(s) and/or in any suitable pattern(s). When mounting base is supported on cured concrete 200, grout or caulk 205 may, in some examples, surround at least a portion of the perimeter of mounting base 112 to fill any gaps between the mounting base and the cured concrete.

Attachment member 114 may include any suitable structure configured to be received in and/or attached to support member 116. The attachment member may be attached to, or formed with, mounting base 112. Attachment member 114 may be any suitable shape(s). For example, the attachment member may be a cylindrical tube (or hollow cylinder). Alternatively, or additionally, attachment member 114 may be a cube, cuboid, cylinder, prism, and/or other suitable shape(s), either in solid or hollow form. When attachment member 114 is a cylindrical tube, the attachment member may sometimes be referred to as a "support post."

Support member 116 may include any suitable structure configured to be supported on mounting base 112, to receive and/or attach to support member 116, and/or to support one or more structural members, such as rails 206 of a fence via fence couplers 207. Support member 116 may be any suitable shape(s). For example, the support member may be a hollow cuboid. Alternatively, or additionally, support member 116 may be a cube, cylinder, prism, tube, and/or other suitable shape(s) in hollow form. Support member 116 may sometimes be referred to as a "main post."

For example, support member 116 may include a receiving hole 122, a plurality of attachment holes 124, and one or more spaced fins 126. The receiving hole may be configured to receive at least a portion of attachment member 114, such as when support member 116 is supported on mounting base 112. Support member 116 may have an inner diameter D1 that is greater than an outer diameter D2 of attachment member 114. In other words, receiving hole 122 may have diameter D1 that is greater than diameter D2 such that the receiving hole may receive the attachment member.

Attachment holes 124 may be configured to be adjacent to attachment member 114 when the attachment member is received in receiving hole 122, such as shown in FIG. 4. The attachment holes also may be sized to receive one or more attachment couplers 208, which may secure support member 116 to attachment 114 when the attachment member is received in receiving hole 122. Support member 116 may include any suitable number of attachment holes 124. Although FIGS. 4-5 show eight attachment holes 124, the support member may include two, three, four, five, six, seven, nine, ten, eleven, twelve or more attachment holes.

Fins or stubs 126 may include any suitable structure configured to receive one or more structural members, such as one or more rails 206 of a fence. Support member 116 may include any suitable number of fins 126, such as two, three, four, five, six, seven, eight, nine, ten or more of the fins. Additionally, fins 126 may be in any suitable positions on the support member. For example, when support member 116 is used as an end post for a fence, the support member may include spaced fins 126 only on one side (such as shown in FIGS. 4-5). Alternatively, when support member 116 is used as a corner post or side post for a fence, the support member may include spaced fins 126 on two or more sides, such as shown in one or more other figures of the present disclosure.

Fins 126 may include one or more coupler openings 128 sized to receive couplers 207. When received in the coupler openings, couplers 207 may be configured to couple rails 206 to fins 126. In some examples, fins 126 located in a top portion of support member 116 may bear at least a substantial portion of the load of the structural members (such as one or more rails of a fence), while the fins located in lower portions of the support member may provide alignment. In some examples, support member 116 may include one or more vents 130.

Figure 6:
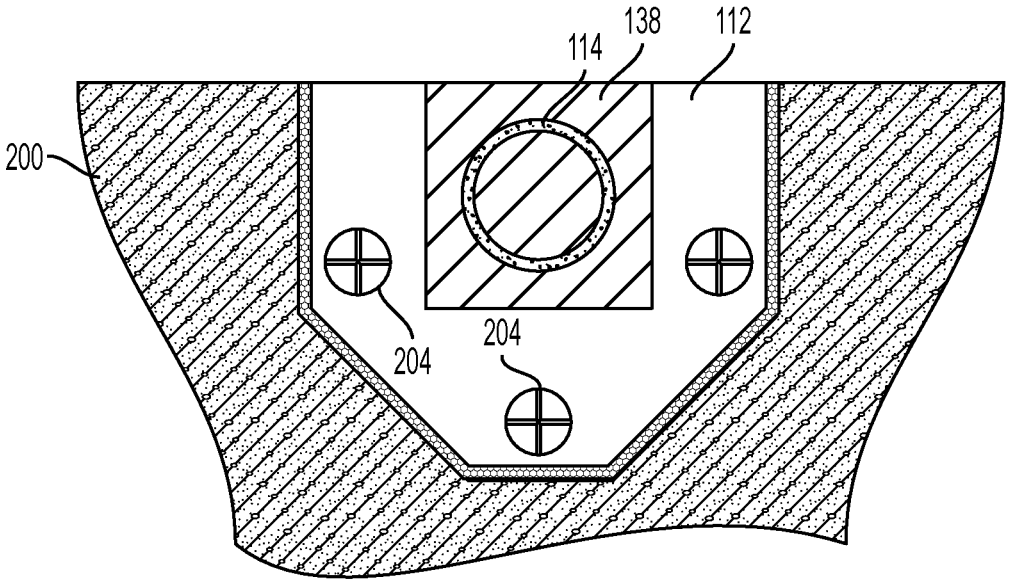
FIG. 6 is a top view of the concrete mounting apparatus of FIG. 4, shown without an attachment assembly.
Figure 7:
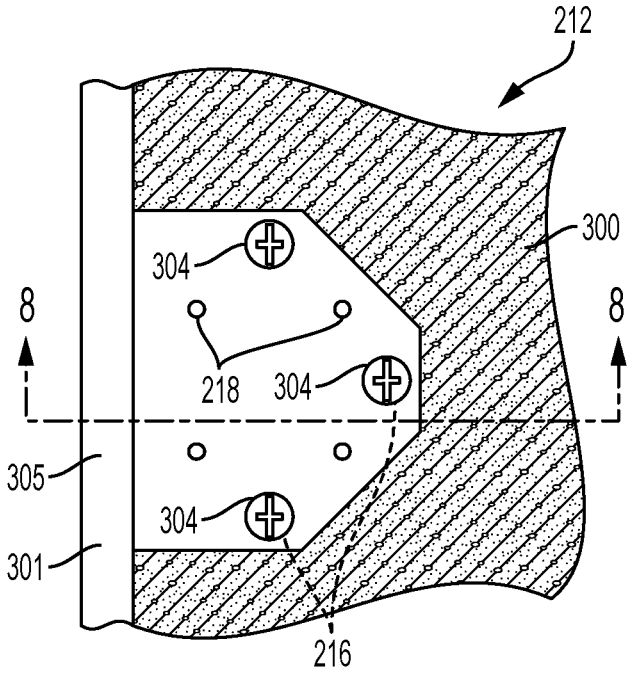
FIG. 7 is a top view of an example of a fastener assembly of the concrete connector installation assembly of FIG. 2.
Figure 8:
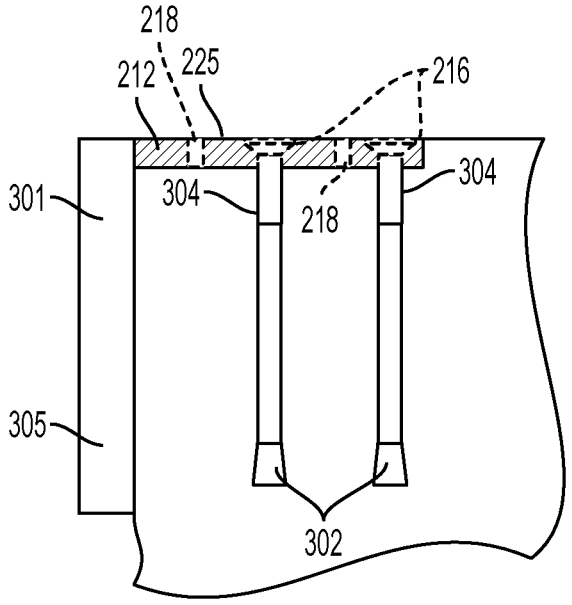
FIG. 8 is a sectional view of the fastener assembly taken along lines 8-8 in FIG. 7, shown without the concrete to show the fasteners and connectors.
Figure 9:
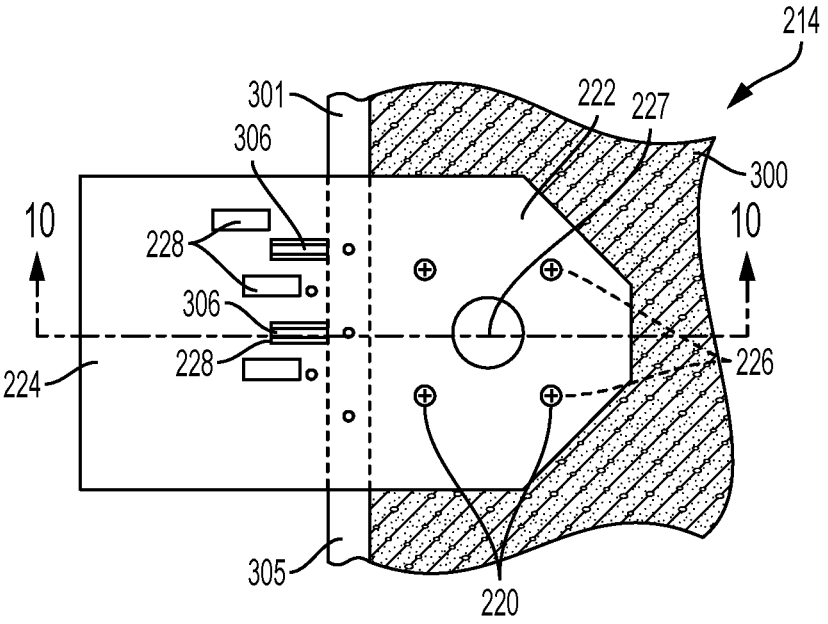
FIG. 9 is a top view of an example of a stabilizing assembly of a concrete connector installation assembly.

In some examples, concrete mounting apparatus 110 may include a cap 132 configured to cover a top portion 134 of support member 116. The cap may include spring clips 136. In some examples, concrete mounting apparatus 110 may include a pad 138, as shown in FIG. 6. The pad may include any suitable structure configured to protect the mounting base from abrasion, such as when the support member is placed on the mounting base. Pad 138 may be made of any suitable materials, such as hard rubber and/or plastic material(s).

As described above, concrete mounting apparatus 110 is supported on cured concrete 200 by connecting the apparatus to one or more concrete connectors 202 buried in the cured concrete via concrete fasteners 204 that are received in formed channels 203 in the cured concrete. FIGS. 7-10 show a concrete connector installation assembly 210 that may be used to install the concrete connectors. Unless specifically excluded, concrete connector installation assembly 210 may include one or more components and/or structures from other concrete connector installation assemblies described in the present disclosure.

Concrete connector installation assembly 210 may include an installation base 212 and a stabilizer base 214. The installation base may include any suitable structure configured to support concrete connectors 302 and concrete fasteners 304 in uncured concrete 300 placed in concrete form 301. Installation base 212 may be any suitable shape(s). For example, the installation base may be planar and be configured to be supported on concrete 300 in concrete form 301. In some examples, the shape of installation base 212 may match the shape of the mounting base that will be used after the concrete is cured and the installation base is removed. In other words, the installation base and the mounting base may occupy the same (or substantially the same) area on the concrete.

Installation base 212 may include a plurality of installation apertures 216 and a plurality of installation holes 218. The installation apertures may be sized to receive one or more of concrete fasteners 304. The installation base may include any suitable number of apertures 216, such as two, three, four, five, six, seven, eight or more apertures. Additionally, apertures 216 may be positioned in any suitable portion(s) and/or in any suitable pattern(s). Holes 218 may be sized to receive one or more mating couplers 220. Installation base may include any suitable number of holes, such as two, three, four, five, six, seven, eight or more holes. Additionally, holes 218 may be located in any suitable portion(s) and/or in any suitable patterns on the installation base. In some examples, holes 218 may correspond to holes on stabilizer base 214 to allow couplers 220 to couple and/or mate the stabilizer base to the installation base, or vice-versa.

Figure 10:
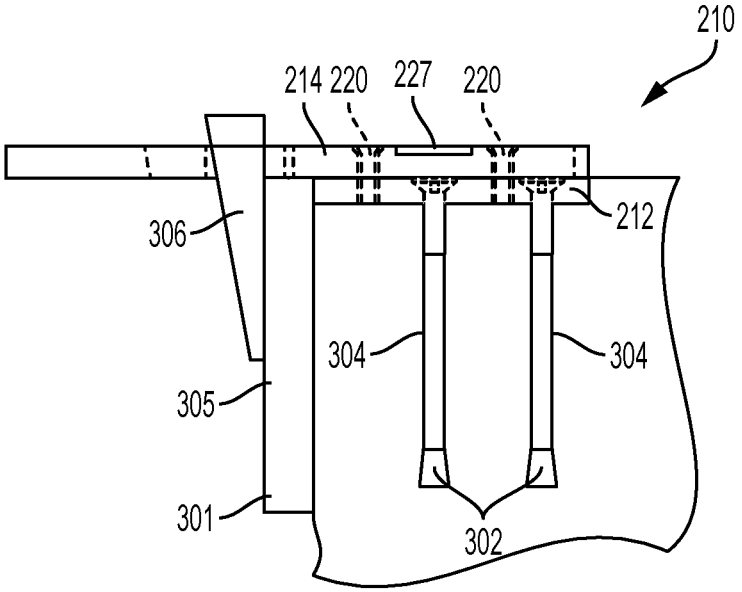
FIG. 10 is a sectional view of the stabilizing assembly of FIG. 9 taken along lines 10-10 in FIG. 9, shown attached to the fastener assembly of FIG. 8.

Stabilizer base 214 may include any suitable structure configured to secure the installation base to the concrete form. The stabilizer base may be planar and/or any suitable shape(s). Stabilizer base 214 may extend outside the concrete form when the stabilizer base is attached to the installation base, as shown in FIG. 10. In some examples, the stabilizer base may extend to and/or contact at least one wall 305 of concrete form 301.

Stabilizer base 214 may include a first portion 222 and a second portion 224. The first portion may have a shape that corresponds to the shape of installation base, and the second portion may extend from the first portion toward wall 305 of concrete form 301. First portion 222 may be configured to be attached to a top portion 225 of the installation base. For example, the first portion may include a plurality of stabilizer holes 226, which may correspond to installation holes 218 of the installation base such that, for example, holes 218 and holes 226 form passages sized to receive mating couplers 220 when the first portion of the stabilizer base is placed on (or over top portion 225 of) the installation base. In some examples, first portion 222 may include a magnet 227, which may be configured to receive a level and/or other suitable alignment device.

Second portion 224 may extend to and/or over at least one wall 305 of concrete form. Additionally, the second portion may include a plurality of stabilizer openings 228 sized to receive one or more stabilizer elements 306. The stabilizer openings may be positioned in any suitable portion(s) and/or any suitable patterns on the second portion. For example, stabilizer openings 228 may be positioned in a staggered pattern such that a stabilizer element 306 may be inserted in one or more of selected openings and that stabilizer element may contact at least one wall 305 of concrete form 301 when the stabilizer base is attached to the top portion and the installation base is supported on the uncured concrete. Stabilizer openings 228 may be sized and/or shaped to receive any suitable stabilizer elements 306. For example, the stabilizer openings may be sized and/or shaped to receive wedge-shaped stabilizer elements 306.

Figure 11:
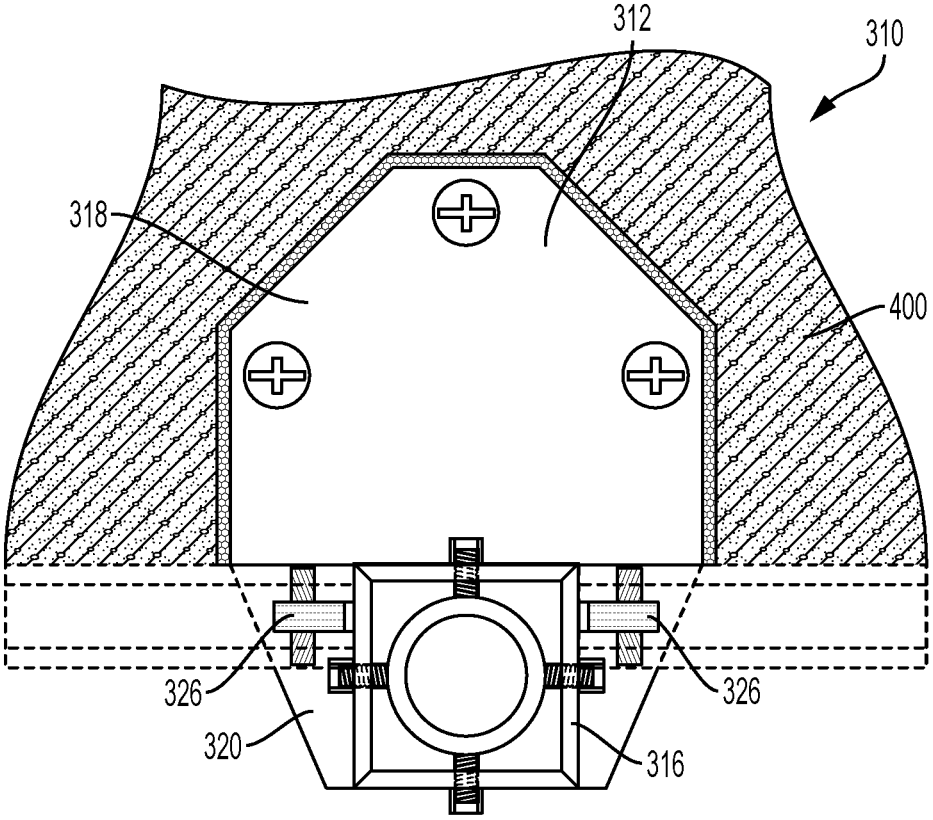
FIG. 11 is a top view of another example of the concrete mounting apparatus of FIG. 1, shown secured to concrete via fasteners and connectors.

Although particular examples of concrete mounting apparatus 20 and concrete connector assembly 40 are shown in FIGS. 4-10, other examples of the concrete mounting apparatus and the concrete connector assembly are included in the present disclosure. For example, FIG. 11 shows another example of concrete mounting apparatus 20, which is generally indicated at 310. Unless specifically excluded, concrete mounting apparatus 310 may include one or more components and/or structures from other concrete mounting apparatuses described in the present disclosure. Concrete mounting apparatus 310 includes a different-shaped mounting base 312 and has fins 326 on opposing sides of support member 316. Mounting base 312 includes a first portion 318 configured to be supported on concrete surface 400, and a second portion 320 configured to be supported on a surface (which may be concrete surface 400 or another type of surface adjacent to concrete 400).

Figure 12:
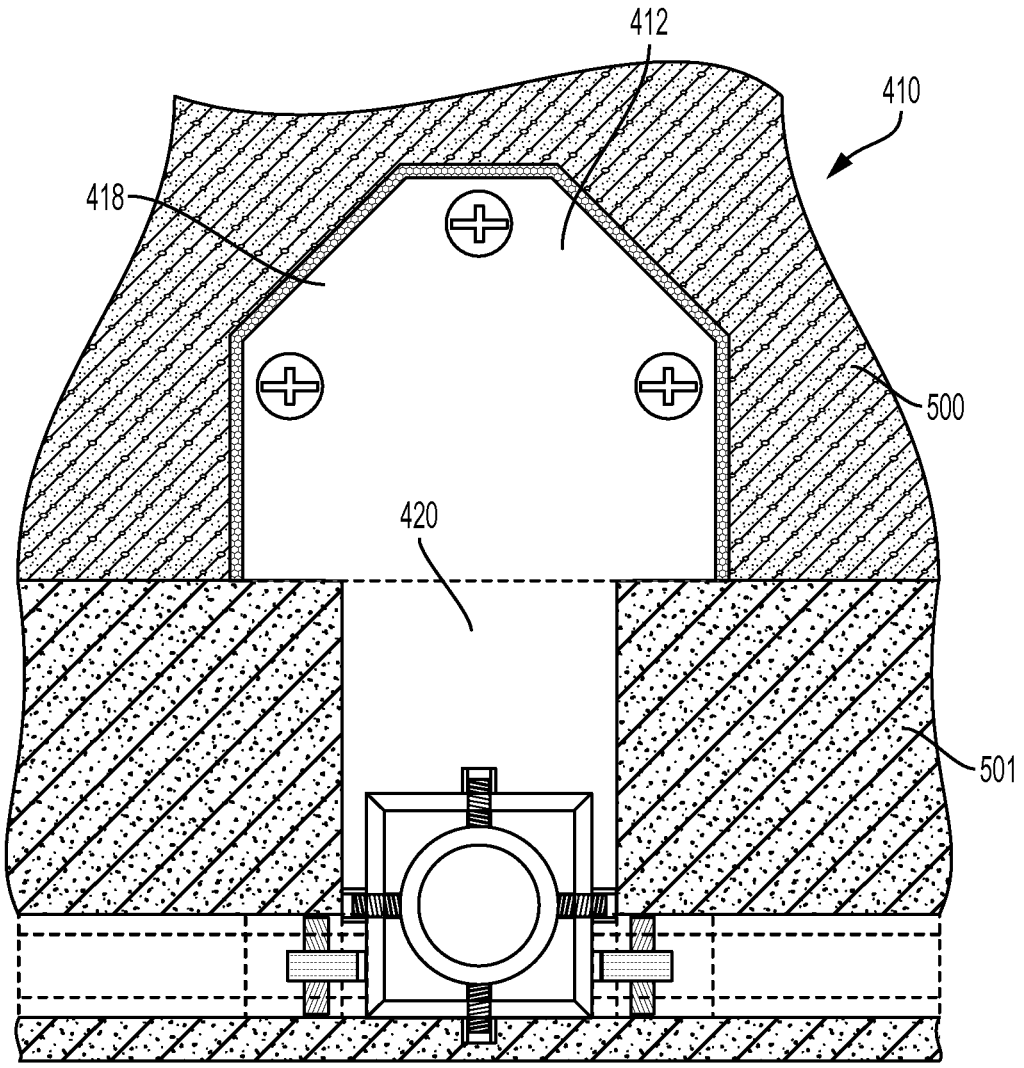
FIG. 12 is a top view of a further example of the concrete mounting apparatus of FIG. 1, shown secured to concrete via fasteners and connectors.

FIG. 12 shows a further example of concrete mounting apparatus 20, which is generally indicated at 410. Unless specifically excluded, concrete mounting apparatus 410 may include one or more components and/or structures from other concrete mounting apparatuses described in the present disclosure. Concrete mounting apparatus 410 is similar to concrete mounting apparatus 310 of FIG. 11 with a mounting base 412 having a similar first portion 418 but with a different-shaped second portion 420. First portion 418 may be configured to be supported on concrete surface 500, while second portion may be configured to be supported on a surface 501 different from concrete surface 500, such as a sand and/or gravel surface. Alternatively, surface 501 may be the same as concrete surface 500.

Figure 13:
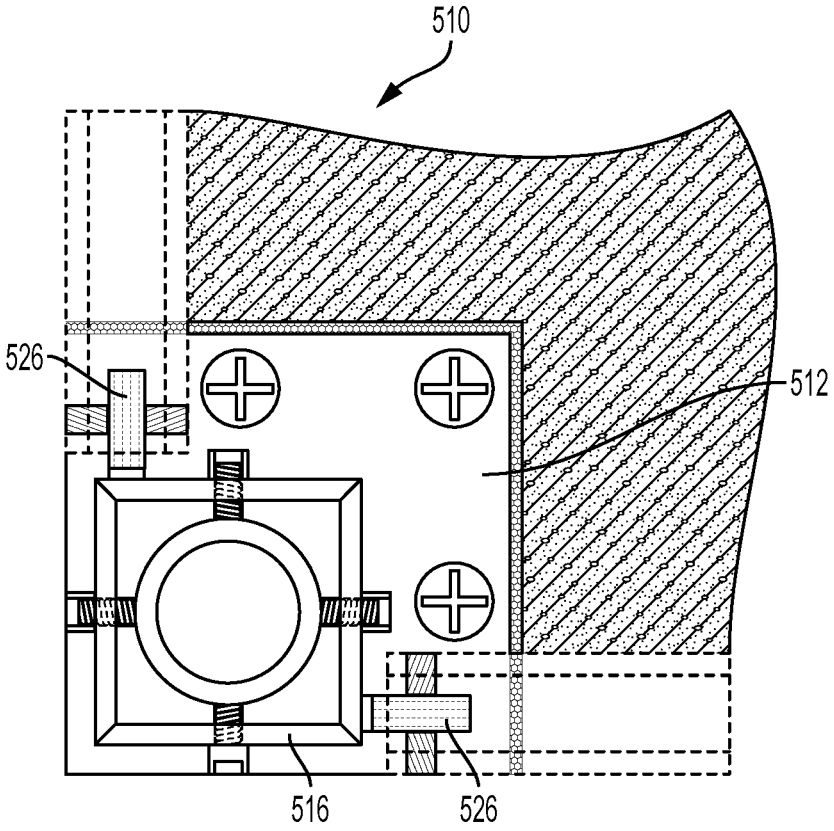
FIG. 13 is a top view of another example of the concrete mounting apparatus of FIG. 1, shown secured to concrete via fasteners and connectors.

FIG. 13 shows an additional example of concrete mounting apparatus 20, which is generally indicated at 510. Unless specifically excluded, concrete mounting apparatus 510 may include one or more components and/or structures from other concrete mounting apparatuses described in the present disclosure. Concrete mounting apparatus 510 includes a different-shaped mounting base 512 and has fins 526 on orthogonal sides of support member 516.

Figure 14:
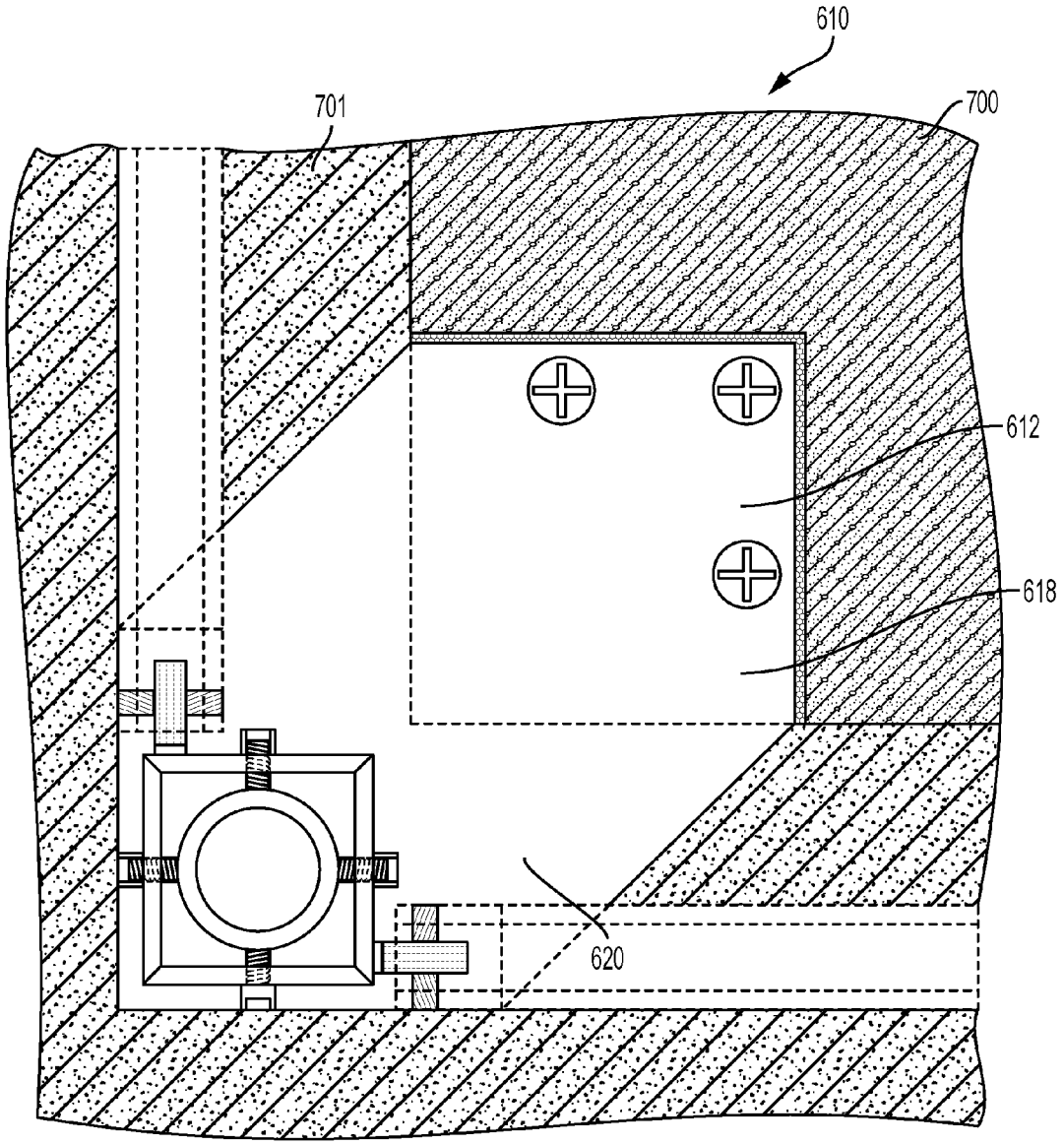
FIG. 14 is a top view of a further example of the concrete mounting apparatus of FIG. 1, shown secured to concrete via fasteners and connectors.

FIG. 14 shows a further example of concrete mounting apparatus 20, which is generally indicated at 610. Unless specifically excluded, concrete mounting apparatus 610 may include one or more components and/or structures from other concrete mounting apparatuses described in the present disclosure. Concrete mounting apparatus 610 is similar to concrete mounting apparatus 510 of FIG. 13 but with a mounting base 612 having a first portion 618 (similar to the entirety of mounting base 512) and a second portion 620. First portion 618 may be configured to be supported on concrete surface 700, while second portion may be configured to be supported on a surface 701 different from concrete surface 700, such as a sand and/or gravel surface. Alternatively, surface 701 may be the same as concrete surface 700.

Figure 15:
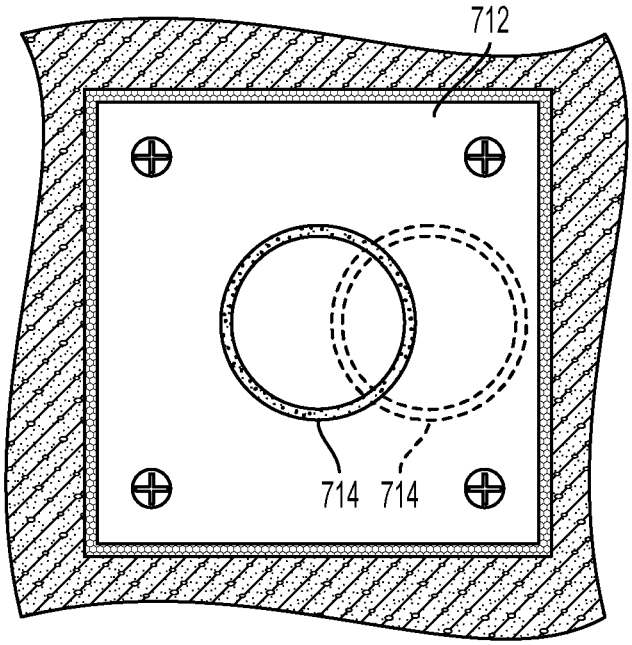
FIG. 15 is a top view of an example of a base assembly of the concrete mounting apparatus of FIG. 1, shown secured to concrete via fasteners and connectors.

FIG. 15 shows a mounting base 712 that may be used for any of the concrete mounting apparatuses described in the present disclosure. Attachment member 714 may be attached to, or formed with, the mounting base at any suitable location of the mounting base as shown in solid and dashed lines in FIG. 15.

Figure 16:
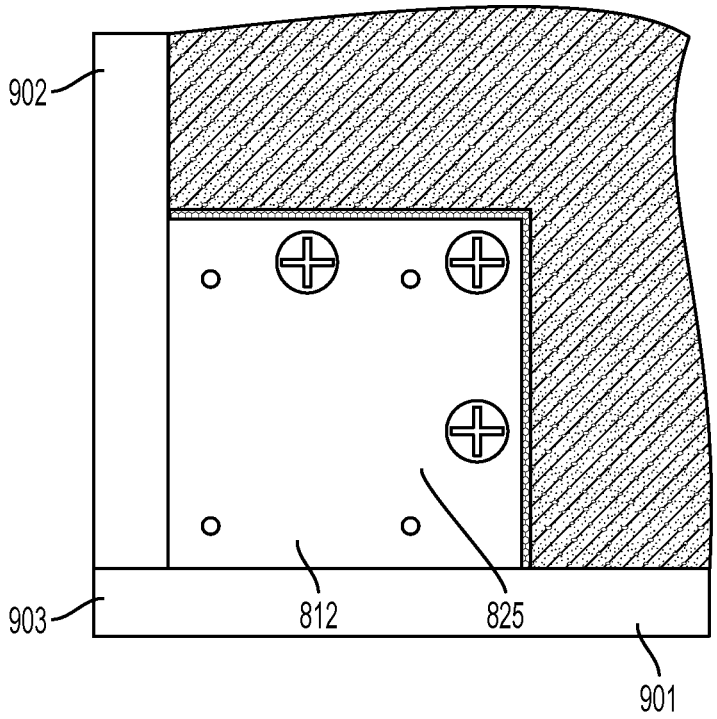
FIG. 16 is a top view of another example of a fastener assembly of the concrete connector installation assembly of FIG. 2.
Figure 17:
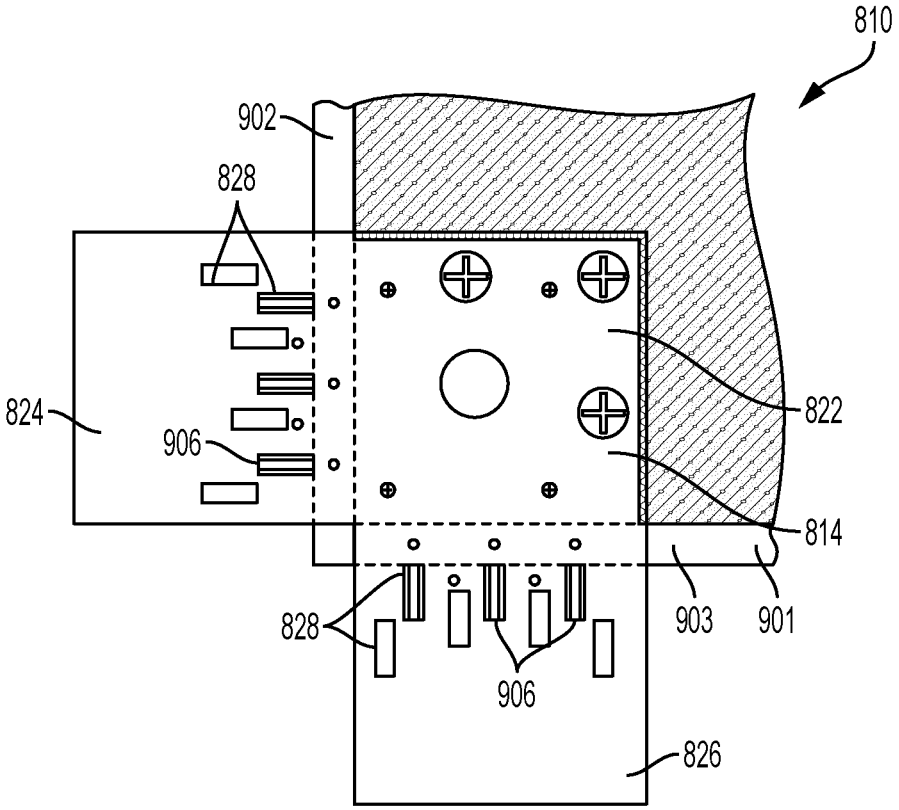
FIG. 17 is a top view of a further example of a fastener assembly of a concrete connector installation assembly.

FIGS. 16-17 show another example of a concrete connector installation assembly 40, which is generally indicated at 810. Unless specifically excluded, concrete connector installation assembly 810 may include one or more components and/or structures from other concrete connector installation assemblies described in the present disclosure. Concrete connector installation assembly 810 is similar to concrete connector installation assembly 210 but with a different shaped installation base 812 and a stabilizer base 814 that extends over two walls 902 and 903 of concrete form 901.

Specifically, stabilizer base 814 includes a first portion 822, a second portion 824, and a third portion 826. The first portion may be configured to be attached to a top portion 825 of installation base 812. Second portion 824 may extend over wall 902, while third portion 826 may extend over wall 903. Both second and third portions may include a plurality of stabilizer openings 828 sized to receive one or more stabilizer elements 906.

Figure 18:
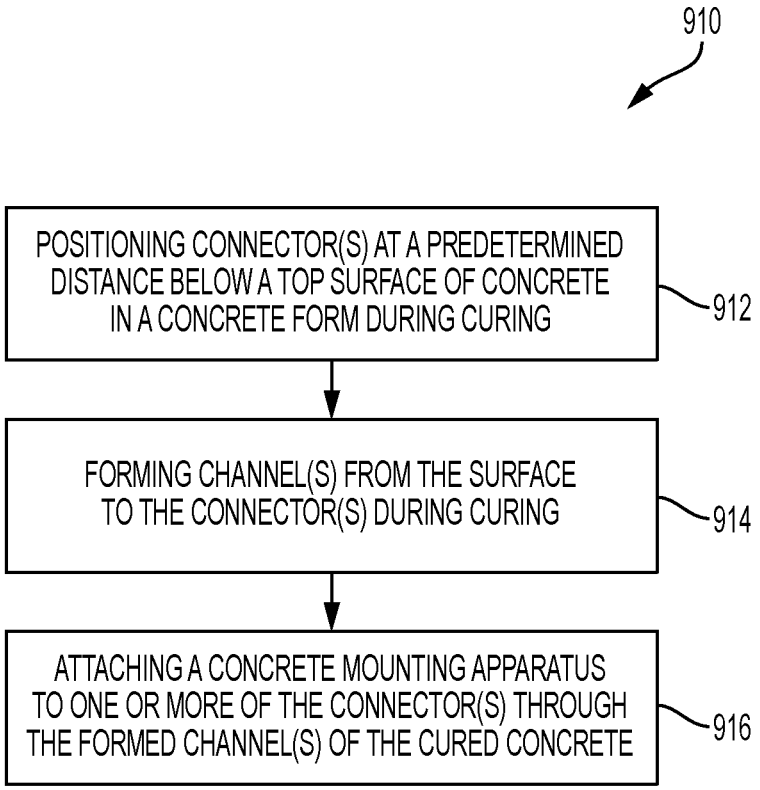
FIG. 18 is an example of a method of installing a concrete mounting apparatus for a fence.

An example of a method of installing a concrete mounting apparatus for a fence is shown in FIG. 18. Although FIG. 18 shows particular steps, other examples of the method may add, omit, repeat, modify, and/or substitute one or more of the steps.

At step 912, the concrete connectors may be positioned at a predetermined distance below a top surface of concrete in a concrete form during curing of that concrete. For example, a plurality of installation fasteners may be inserted into or in a plurality of apertures of an installation base. Additionally, the plurality of installation fasteners and at least a bottom surface of the installation base may be shielded, such as to prevent the fasteners and/or base from adhering to the concrete when cured. In some examples, one or more (or all) side surfaces of the installation base also may be shielded. Moreover, the installation base may be placed on a top surface of the concrete during curing of that concrete such that the plurality of connectors are at the predetermined distance below the top surface.

In some examples, a stabilizer base may be attached to the installation base, such as prior or subsequent to placing the installation base on the top surface of the concrete. The stabilizer base may include a plurality of openings configured to receive one or more stabilizer elements. Additionally, one or more stabilizer elements may be inserted in the plurality of openings. In those examples, placing the installation base may include positioning the stabilizer base such that one or more of the stabilizer elements contact at least one outside wall of the concrete form. In some examples, at least one wall of the concrete form may be disposed between at least one stabilizer element and the installation base when installed.

In some examples, one or more greases may be applied to the installation fasteners for shielding those fasteners. Additionally, or alternatively, the installation fasteners may be enclosed with one or more wraps and/or tape. Moreover, sheeting may be attached to one or more surfaces (such as the bottom surface and/or side surface(s)) of the installation base, such as plastic or aluminum foil sheeting, for shielding the surface(s) of that base.

At step 914, one or more channels may be formed from the top surface to the plurality of connectors during curing of the concrete. For example, the plurality of installation fasteners (or shielded installation fasteners) may be detached from the plurality of connectors when the concrete is cured (or almost cured). Additionally, the plurality of installation fasteners and the installation base may be removed from the top surface of the concrete.

At step 916, a concrete mounting apparatus (such as one or more of the concrete mounting apparatus described above) may be attached to one or more of the plurality of connectors through the one or more formed channels of the cured concrete. The concrete mounting apparatus may be configured to support one or more rails of the fence (and/or one or more structural members of other structures). For example, one or more mounting fasteners may be inserted in the plurality of apertures of the mounting base. In some examples, the mounting fasteners may be the same as the installation fasteners described above.

Additionally, the mounting base may be positioned on the top surface of the cured concrete such that the one or more mounting fasteners are received in the formed channels. When the installation base and the mounting base has the same area, the mounting base may be positioned in a cavity of the cured concrete formed by the removal of the installation base from the cured concrete. In other words, the installation base may form a cavity in the cured concrete, and the mounting base may be placed in that same cavity.

Moreover, the one or more mounting fasteners in the formed channels may be attached to the connectors that are buried in (or completely below the top surface of) the concrete. Furthermore, a support member may be positioned such that the hole of that support member may receive the attachment member of the concrete mounting apparatus. Additionally, one or more couplers may be inserted in the holes of the support member to secure the support member to the attachment member.

In some examples, grout and/or caulk may be applied, if necessary, between the concrete mounting apparatus and the cured concrete, such as in one or more gaps between the concrete mounting apparatus and the cured concrete. In some examples, one or more doughnut-type shims or washers may be placed on the top surface of the cured concrete prior to positioning the concrete mounting apparatus on the top surface of the cured concrete, such as to vertically align the concrete mounting apparatus.

When the concrete mounting apparatus is no longer desired, a user may disconnect the couplers and remove the support member. The user may disconnect the fasteners from the concrete connectors and remove the fasteners, attachment member, and mounting base. If desired, the cavity and/or formed channels may be filled with caulk and/or grout.

Although the structures, components, and steps of the present disclosure are shown and described to be used as part of a fence and a mounting system and method for that fence, the structures, components, and steps of the present disclosure may alternatively be used for gates, flag poles, sports structures (e.g., tennis court nets, basketball hoops, etc.), play structures (e.g., swings, slides, see-saws, etc.), wall and/or other building structures, and/or other structures that must be secured to concrete. For example, a basketball hoop or flag pole may be removably attached to the base assembly via suitable couplers.

The disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A concrete mounting apparatus for a fence, comprising:

a mounting base that is planar and is configured to be supported on concrete, the mounting base has a plurality of apertures sized to receive one or more fasteners;

an attachment member directly attached to, or formed with, the mounting base; and a support member configured to be supported on the mounting base, the support member includes:

a first hole configured to receive at least a portion of the attachment member when the support member is supported on the mounting base, a plurality of second holes that is adjacent to the attachment member when the attachment member is received in the hole, the plurality of second holes is sized to receive one or more first couplers to secure the support member to the attachment member, each of the one or more first couplers includes opposing first and second end portions, wherein the plurality of second holes is positioned such that, when the attachment member is received in the first hole and when the one or more first couplers are received in the plurality of second holes, the first end portion of the received one or more first couplers contacts the attachment member to secure the support member to the attachment member and the second end portion of the received one or more first couplers is external the concrete mounting apparatus to allow a user access to the received one or more first couplers, and wherein each second hole of the plurality of second holes is (1) spaced laterally from one or more other second holes and (2) spaced longitudinally from one or more other second holes, and one or more spaced fins configured to receive one or more rails of the fence.

2. The apparatus of claim 1, wherein the attachment member is a first cylindrical tube having an outer diameter.

3. The apparatus of claim 2, wherein the support member includes an inner diameter that is greater than the outer diameter of the first cylindrical tube.

4. The apparatus of claim 1, wherein the support member includes a plurality of vents.

5. The apparatus of claim 1, further comprising a cap configured to cover a top end portion of the support member.

6. The apparatus of claim 1, wherein the one or more fins include one or more openings sized to receive second couplers configured to couple the one or more rails to the one or more fins.

7. The apparatus of claim 1, wherein further comprising a pad attached to the mounting base and configured to support the support member.

* * * * *